US010383488B2

(12) United States Patent
Ziebart et al.

(10) Patent No.: US 10,383,488 B2
(45) Date of Patent: Aug. 20, 2019

(54) DISPENSER FOR ROLL OF CORELESS WEB MATERIAL

(71) Applicant: San Jamar, Inc., Elkhorn, WI (US)

(72) Inventors: Bernie Ziebart, Pewaukee, WI (US); Michael Young, Mukwonago, WI (US)

(73) Assignee: San Jamar, Inc., Elkhorn, WI (US)

( * ) Notice: Subject to any disclaimer, the term of this patent is extended or adjusted under 35 U.S.C. 154(b) by 336 days.

(21) Appl. No.: 15/368,784

(22) Filed: Dec. 5, 2016

(65) Prior Publication Data

US 2018/0153359 A1 Jun. 7, 2018

(51) Int. Cl.
*A47K 10/38* (2006.01)
*A47K 10/32* (2006.01)

(52) U.S. Cl.
CPC ..... *A47K 10/38* (2013.01); *A47K 2010/3206* (2013.01); *A47K 2010/3253* (2013.01)

(58) Field of Classification Search
CPC .... A47K 2010/3206; A47K 2010/3233; A47K 2010/3253; A47K 10/3687; A47K 10/40
USPC ..... 242/596.3
See application file for complete search history.

(56) References Cited

U.S. PATENT DOCUMENTS 3,418,029 A * 12/1968 Wooster ..... A47K 10/38 242/596.3
4,961,613 A * 10/1990 Biggar ..... A47K 10/36 225/52
4,974,783 A * 12/1990 Campbell ..... A47K 10/40 242/160.1
5,028,097 A * 7/1991 Tucker ..... A47K 10/40 312/34.8
5,370,336 A 12/1994 Whittington
5,370,339 A 12/1994 Moody et al.
5,495,997 A 3/1996 Moody
5,669,576 A 9/1997 Moody
5,697,576 A 12/1997 Bloch et al.
5,868,342 A 2/1999 Moody et al.
6,070,821 A 6/2000 Mitchell
6,202,956 B1 3/2001 Grasso et al.
6,360,985 B1 3/2002 Phelps et al.
6,439,502 B1 8/2002 Gemmell et al.
(Continued)

FOREIGN PATENT DOCUMENTS

EP 1033100 A2 9/2000
EP 1941821 A1 7/2008
JP S5559997 U 4/1980

OTHER PUBLICATIONS

Extended European Search Report dated Apr. 5, 2018 (EP Application No. 17205496.7).

*Primary Examiner* — William E Dondero
(74) *Attorney, Agent, or Firm* — Boyle Fredrickson S.C.

(57) ABSTRACT

A coreless web material dispenser or dispensing apparatus that includes a flexible brace that is configured to support a roll of coreless web material relative to the dispenser. The flexible brace is supported by the housing such that closing a cover of the dispensing apparatus biases a portion of the brace into operative engagement with the roll of coreless web material. Preferably, the flexible brace includes at least one protrusion that extends inwardly relative to a roll facing side of the brace and defines a rotational axis upon which the roll of the coreless web material may rotate while one or more side portions of the flexible brace limit lateral movement of the roll during dispensing events.

23 Claims, 6 Drawing Sheets

(56) References Cited

U.S. PATENT DOCUMENTS

| | | | | |
|---|---|---|---|---|
| 6,502,781 | B1 | 1/2003 | Tramontine | |
| 7,219,852 | B2 | 5/2007 | Tramontine et al. | |
| 7,513,453 | B2 * | 4/2009 | Cattacin | A47K 10/38 242/596.7 |
| 7,841,558 | B2 | 11/2010 | Elliott et al. | |
| 7,861,964 | B2 | 1/2011 | Cittadino et al. | |
| 7,988,085 | B2 * | 8/2011 | Cattacin | A47K 10/38 242/596.7 |
| 2006/0038054 | A1 * | 2/2006 | Tramontina | A47K 10/38 242/560 |

* cited by examiner

DISPENSER FOR ROLL OF CORELESS WEB MATERIAL

BACKGROUND OF THE INVENTION

This invention relates generally to dispensers for dispensing roll material. More particularly, this invention relates to a coreless roll dispenser for incrementally dispensing bath tissue from a coreless roll or bulk material and having a flexible roll brace for supporting the roll while allowing rotation of the roll during discrete dispensing events.

Dispensers for rolls of flexible sheet material, such as bath tissue, toilet tissue and paper towels, have been employed for many years. Such dispensers are widely used in public lavatories to dispense sheet material for users. Typically, in the context of toilet tissue, one or more rolls of web material are rotatably supported inside a dispenser cabinet. Often these dispenser cabinets are configured to generally enclose two rolls of material to minimize the frequency associated with restocking of the dispenser. In these systems, a first roll of material is made available to the user while the other is stored in the dispenser. The second roll frequently only becomes available for use or dispensing upon depletion of the material associated with the first roll.

Many conventional roll dispensers have a spindle about which the roll of material is placed when the dispenser is stocked. Typically, the spindle extends through the core of the roll, from one side of the roll of material to the opposing side. The spindle is then affixed to the dispenser structure as both ends. In this configuration, the spindle supports both sides of the roll of material, and allows the core of the roll to freely rotate, as to cause or allow the sheet material to be advanced from the roll and thereby dispensed from the dispenser. U.S. Pat. No. D307845 discloses a design for such a toilet tissue dispenser configured to receive conventional rolls of toilet tissue. Such dispensers, which employ traditional spindles, require rolls of web material to be disposed about a central hollow core. The spindle is then inserted into the hollow core and facilitates rotation of the roll about the spindle during dispensing events. When the roll of web material has been depleted, the core remains within the dispenser, until the dispenser is restocked; at which time the core must commonly be removed from the spindle and is subsequently discarded.

Increasingly, web material product manufacturers as well as users of such dispensers prefer the use of coreless rolls of toilet tissue. Elimination of the core during manufacturing process reduces cost and waste associated with production of rolls of web material. Use of coreless rolls of web material in dispensers, such as toilet tissue, avoids the need to remove the core associated with a depleted roll of web material during restocking processes. As a result, restocking coreless rolls of web material offers a significant time savings as compared to the restocking of conventional rolls of web material that include a core. Furthermore, use of coreless rolls produce less waste products as there is no resulting core to be discarded. As alluded to above, the manufacture of rolls of web material that lack a core may be more economical than those requiring the additional core material and can eliminate manufacturing steps associated with wrapping web material about a core which must be stored and subsequently positioned to receive the web material.

However, while the desire for use of coreless rolls of toilet tissue is increasing, conventional dispensers are not well suited to accommodate coreless rolls. That is to say, that coreless rolls of web material, in which web material is rolled into an uninterrupted roll having a solid center, do not readily provide a longitudinally extending space or conduit through which a spindle or other supporting structure may be extended and supported or otherwise secured to an underlying dispenser. In the absence of a hollow core, there is need for a dispenser or dispensing system that allows coreless rolls of web material to be securely retained within the dispenser while simultaneously allowing the roll to rotate about the roll's central axis in a conventional manner to accommodate incremental dispensing of the roll.

Accordingly, a need exists for a roll dispenser that allows coreless rolls of web material to be secured within a dispenser housing that limits lateral movement of the roll while facilitating rotational movement in response to a user exerting a pulling force on the web material when removing a length of the web material during each discrete dispense event. Preferably, the force associated with tearing or separating discrete portions of the web material from the roll is greater than the pulling force to mitigate tearing of the web material during each dispensing event until desired by the discrete users.

SUMMARY OF THE INVENTION

The present application discloses a dispenser or dispensing apparatus that is configured to incrementally dispense web material from a coreless roll of web material in a manner that overcomes one or more of the aforementioned drawbacks. As will be described more fully herein, one aspect of the invention discloses a web material dispenser or dispenser apparatus for use with coreless rolls of web material such as a toilet tissue, and a roll brace associated with the dispenser to secure the coreless roll of web material within a housing of the dispenser while facilitating rotational movement of the roll to facilitate the incremental dispensing of the web material from the coreless roll. In one aspect of the invention, the apparatus includes a housing having a base, a cover, and a cavity defined between the base and the cover. At least one roll brace extends from the base toward the cover and is configured to retain a roll of coreless web material within the housing. When the housing is in a closed orientation, the at least one brace receives a compression force associated with interaction of the brace with the cover resulting in the compression of the at least one brace about the roll.

Another aspect of the invention that includes or is usable with one or more of the above features or aspects discloses a roll brace having first and second inwardly directed protrusions, which are coaxially aligned when the housing is in a closed orientation to provide a rotational axel for the coreless roll of web material retained therein.

Another aspect of the invention that includes or is usable with one or more of the above features or aspects is a roll brace having a distance between the first and second inwardly directed protrusions, which is approximately greater than or equal to the width of the coreless roll of web material, when the housing is in an open orientation to accommodate insertion and loose support of the coreless roll of web material disposed therein.

Another aspect of the invention that includes or is usable with one or more of the above features or aspects discloses a roll brace having a distance between the first and second inwardly directed protrusions, which is less than the width of the coreless roll of web material, when the housing is in an closed orientation to inhibit lateral movement of the coreless roll of web material relative to the roll brace and secure the protrusion in their generally coaxial alignment at the center of the coreless roll of web material.

Yet another aspect of the invention includes or is usable with one or more of the above features or aspects is the roll brace having a tab protruding outwardly from a side of the roll brace that faces away from the roll of web material. The tab is configured to engage an inner surface of the front or cover of the dispenser when the housing is in a closed orientation, and translate a compression force to the roll brace as to compress the roll brace about the coreless roll.

Each of the aspects disclosed above provides a dispensing activity for a web material that does not rely upon the presence of a core in a roll of the web material. Each of the aspects disclosed above provides a dispenser that facilitates the use of coreless rolls of web material in the context of receiving, securing and/or dispensing web material from a coreless roll, which does not result in the undesirable presence of a core from depleted rolls of web material that would otherwise need to be removed during restocking of the dispenser.

Various other features, aspects and advantages of the invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
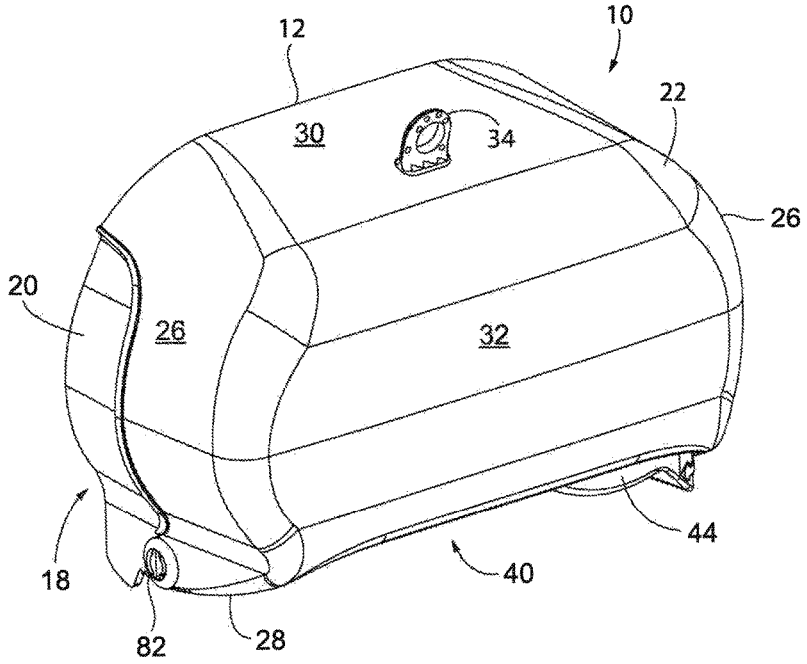
FIG. 1 is a perspective front side view of a roll dispenser in a closed orientation, the dispenser comprising a coreless roll brace in accordance with one embodiment of the present invention.

In describing the preferred embodiments of the invention which are illustrated in the drawings, specific terminology is resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENTS

FIG. 1 shows a dispenser or dispensing system 10 that is constructed to dispense at least one coreless roll of web material according to one embodiment of the present invention. The dispensing system 10 includes a dispenser 12 that is configured to cooperate with a roll brace or brace 14 (FIG. 3) that, when operated, allows the dispenser to sequentially dispense discrete amounts of a sheet material from a bulk coreless roll of web material for use by discrete users.

Figure 2:
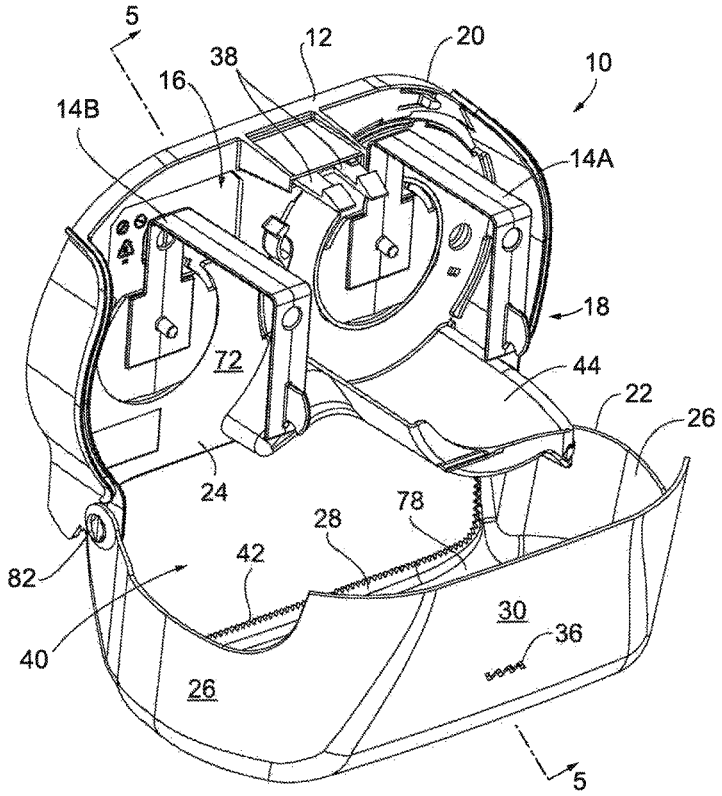
FIG. 2 is a perspective view of a the roll dispenser of FIG. 1, shown in an open orientation.

Referring initially to FIGS. 1-2, dispenser 12 is configured to hold a coreless roll of web material inside a cavity 16 defined by a housing 18. The housing 18 comprises a base 20 and a cover or front cover 22, which may be removably, pivotably, or hingedly connected to the base 20, such that the cover is movable relative to the base between a closed position, as shown in FIG. 1, and an open position, as shown in FIG. 2. Opening of front cover 22 allows access to cavity 16 to facilitate loading or service of dispenser 12.

Base 20 generally defines a back wall 24 of the housing 18 while the cover 22 defined at least a portion of opposing sidewalls 26, a floor 28, a top 30 and a front 32 of dispenser 12. It is appreciated that portions of sidewalls, floor, top and front of dispenser 12 may be formed by portions of base 20. Preferably, cover 22 cooperates with base 20 in a manner that allows generally unobstructed access to the cavity 16 of dispenser 12. The housing 18 may be formed of any suitable material and is preferably formed of a plastic material.

The front cover 22, which preferably includes sidewalls 26, floor 28, top 30 and front 32 of dispenser 12 may be constructed as a single piece or having a generally unitary construction and can be formed by any of injection, blow, or roto molding when formed of plastic materials. Alternatively, the various walls or panels that define housing 18 may be separately manufactured parts that are connected to one another by one or more suitable manners such as weldments, moldings, fasteners, solder, or the like.

Still referring to FIG. 1, when in the closed orientation shown, a key 34 is preferably provided that may extend through a hole 36 in the top 30 of the cover 22, and engage one or more locking tabs 38, which extend from the base 20, forward of the back wall 24. It is further appreciated that the selective locking function associated with the cooperation of key 34 and tabs 38 can be provided in various configurations such as push buttons or the like for those applications where keyed opening of dispenser 12 is not required or desired. When oriented in the closed orientation, the base 20 and cover 22 define an aperture 40 proximate the floor 28 of the dispenser 12 and associated with the incremental removal of the web material from the dispenser during use of dispenser 12. Referring to FIGS. 1 and 2, dispenser 12 preferably includes a knife or other cutting tool in the form of a serrated edge 42 (FIG. 2) that preferably extends about at least a portion of aperture 40.

Still referring to FIGS. 1 and 2, dispenser 12 preferably includes a movable roll shield 44 that may extend from and be movably, pivotably, or slidably associated with the back wall 24 of housing 18. As shown in FIG. 2, the movable roll shield 44 may initially be disposed adjacent, i.e., below, a first roll brace 14A. In this configuration, when the roll of web material associated with the second roll brace 14B is consumed, the movable roll shield 44 may be rotated, slid, or other moved relative to the back wall 24 of the housing 18 to expose the coreless roll of web material associated with first roll brace 14A when the user exerts a force on the roll shield 44 in the direction of the second roll brace 14B such that a roll of web material associated with the first roll brace 14A is then made accessible to the user.

Figure 3:
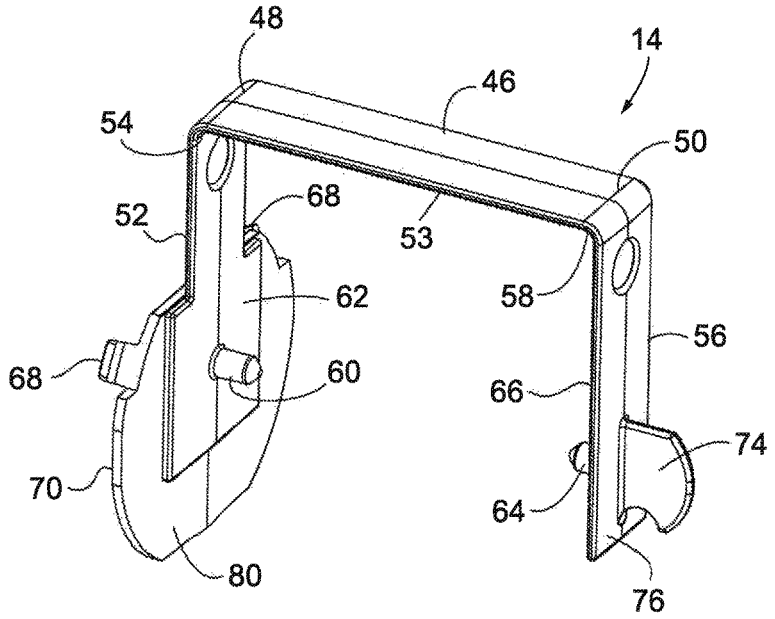
FIG. 3 is a perspective view of the coreless roll brace shown in FIG. 2.
Figure 4:
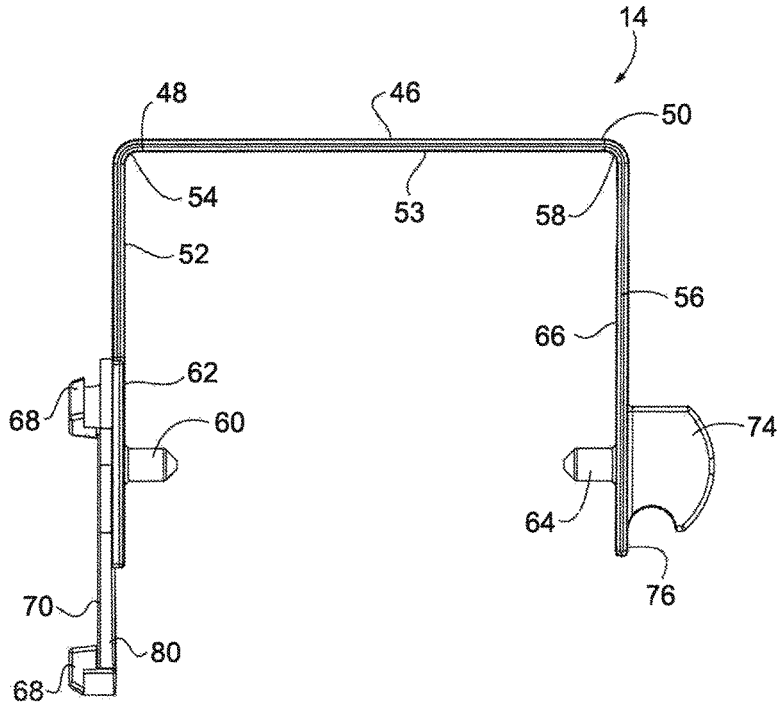
FIG. 4 is a side elevation view of the coreless roll brace shown in FIG. 2.

Turning now to FIGS. 2-4, dispenser 12 includes at least one roll brace 14 and preferably includes a first roll brace 14A and second roll brace 14B that are each constructed to operational support a coreless roll of web material. It is appreciated that dispenser 12 can be provided in a single roll dispenser configuration wherein dispenser 12 includes only one roll brace 14, or more than two roll braces 14 to achieve more than two rolls of material dispensing configurations.

Figure 5:
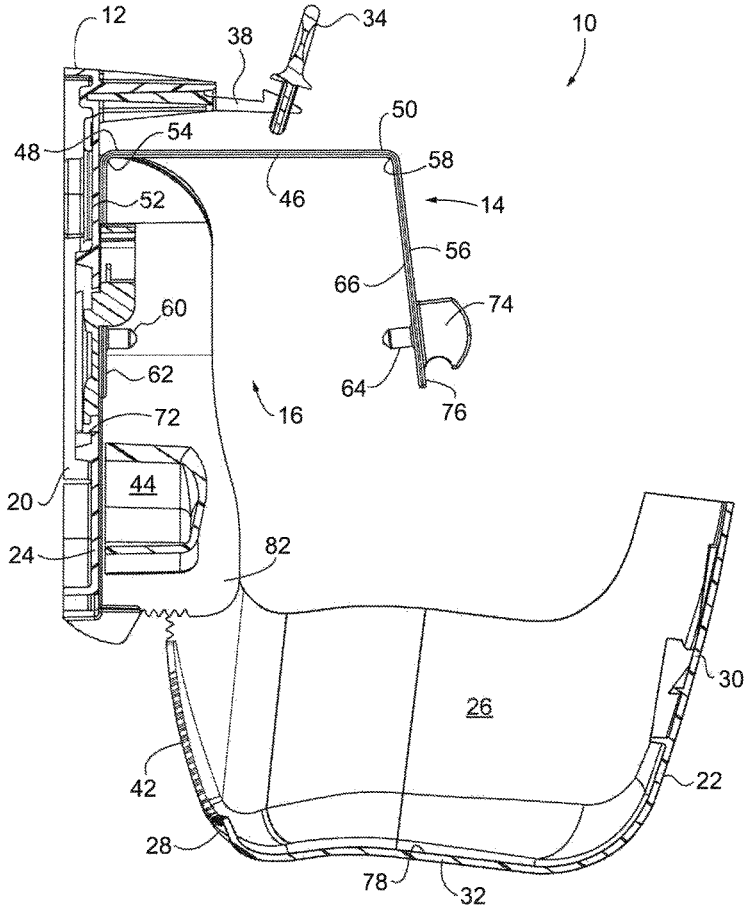
FIG. 5 is a cross section side elevation view of the dispensing apparatus shown in an open orientation and taken along 5-5 shown in FIG. 2.

Referring to FIGS. 2 and 3, each brace or roll brace 14, 14A, 14B includes a first portion or an arm 46 generally defined by a first end 48, a second end 50, and a length 53 extending between the first end 48 and the second end 50. A second portion or a first side 52 of each roll brace 14, 14A, 14B extends downwardly from the first end 48 at a first angle 54, while an opposing third portion or second side 56 of each roll brace 14, 14A, 14B extends downwardly from the second end 50 of the arm 46 of the respective roll brace 14, 14A, 14B, at a second angle 58. Each of first side 52 and second side 56 of a respective roll brace 14, 14A, 14B extend from a respective arm 46 at crossing directions relative to the longitudinal length 53 of the respective arm 46. Preferably, each first side 52 and second side 56 of a respective brace 14, 14A, 14B extend in a common outward radial direction relative to the respective arm 46. As shown in FIG. 4, arms 54, 56 are oriented generally parallel to one another when cover 22 is closed and can be oriented generally parallel to one another when cover 22 is closed. More preferably, as shown in FIG. 5, side 56 extends in a slightly crossing and substantially less than transverse direction relative to a longitudinal axis associated with side 52 when cover 22 is open. Such a consideration improves the ease with which a discrete roll of coreless web material can be associated with respective braces 14, 14A, 14B during loading operations. Said in another way, sides 52, 56 can be provided to have an at rest configuration wherein the sides are parallel to one another but more preferably are oriented at a slightly crossing direction such that the terminal ends of protrusions are more offset from one another as compared to their relative positions when cover 22 is closed as disclosed further below. Preferably, sides 52, 56 are oriented such that a user can associate a coreless roll of web material with protrusions 60, 64 in a single handed manner and in a manner wherein, once positioned, the cooperation of protrusions 60, 64 with a generally axial center area of the coreless roll of web material, regardless of the specific configuration of the axial center area of the coreless roll or web material, is supported via cooperation with the respective brace 14, 14A, 14B.

A first projection or protrusion 60 extends from the inner surface 62 of the first side 52, towards the opposing second side 56, while a second projection or protrusion 64 extends from the inner surface 66 of the second side 56 towards the opposing first side 52. Additionally, one or more projections or mounting tabs 68 may extend rearwardly from the outer surface 70 of the first sides 52 towards the inner surface 72 of the back wall 24 of the base 16, while a tab 74 extends forwardly of the outer surface 76 of the second side 56 towards the inner surface 78 of the cover 22. Tabs 68 associated with each roll brace 14, 14A, 14B and back wall 24 are constructed such that each of roll braces 14, 14A, 14B can be snap-fittingly secured relative to housing 18.

Although protrusions 60, 64 are shown as generally cylindrical shaped stems, it is appreciated that protrusions 60, 64 can be provided in various shapes and sizes. For instance, it is envisioned that protrusions 60, 64 can be provided as generally smooth or barbed stems constructed to be manually pressed into the center of a coreless roll of web material. It is further appreciated that protrusions 60, 64 could alternatively be constructed to cooperate with or form a detent proximate an axial centerline associated with a discrete roll of web material. It is further appreciated that protrusions 60, 64, when provided in a barbed configuration, could be constructed to removably or rotationally cooperate with the respective sides 52, 56 associated with a respective roll brace 14, 14A, 14B or be constructed as an insert having a barbed or otherwise ribbed surface configured to engage the center portion of a coreless roll of web material and include a cavity shaped to slideably and rotationally cooperate with a generally cylindrical projection—such as protrusions 60, 64. When provided in such a configuration, it is appreciated that the barbed inserts may be reuseable and/or disposable.

Such considerations allow dispenser 12 to be used to dispense coreless rolled web material products having various axial center configurations such as only partial, incomplete, and small diameter coreless axial center portions, an axial center dimple or other depression or discontinuity, etc. Further, such considerations allow dispenser 12 to be quickly and economically configured for use with coreless rolled web material products having various axial center portion constructions. For instance, should the manufacturers of the coreless rolled web material change or otherwise alter the length or the construction of the end faces associated with the coreless rolled web material, braces 14, 14A, 14B, and/or the size, shape, and or position of protrusions 60, 64, can be replaced or manipulated to maintain operability of dispenser 12 with various configurations of the coreless rolled web material without requiring replace of the entirety of dispenser 12. It is further appreciated that, when braces 14, 14A, 14B are formed of a plastic material, one or more mold inserts or the like can be implemented such that the size, shape, and/or position of protrusions 60, 64 can be manipulated to accommodate use of braces 14, 14A, 14B, and thereby dispenser 12, with products having alternate manufacturer and/or coreless roll web material product configurations as well as other coreless rolled web material variations such as rolls of different lengths and/or widths. Such considerations further improve the versatility associated with placement and continued use of dispenser 12 as coreless rolled web material manufacturers manufacturing and/or product preferences change over time.

As alluded to above and disclosed further below, tab 74 associated with second side 56 of each discrete roll brace 14, 14A, 14B is constructed to cooperate with cover 22 such that, when cover 22 is closed and a coreless roll of web material is associated with one or more of roll braces 14, 14A, 14B, each roll brace 14, 14A, 14B, and the respective protrusions 60, 64 associated therewith, are compressed into operative engagement with a respective coreless roll of web material. As used herein, the compressed operative engagement between the respective roll braces 14, 14A, 14B and the underlying coreless roll of web based material is to be understood as a selective rotational association wherein the respective roll brace and the underlying roll are associated with one another such that the roll can rotate in response to a user pull force without separation or tearing of the web based material until desired by the user. The operative rotational association is further defined as a cooperation between the discrete roll of coreless web material and the respective roll brace wherein binding or wedging of the respective roll relative to the respective roll brace is limited or otherwise mitigated to facilitate manual incremental dispensing of the entire contents of the coreless roll of web material until the discrete roll of material is depleted or otherwise consumed.

Tab 74 associated with each respective roll brace 14, 14A, 14B is further constructed to facilitate placement of an initial and/or subsequent coreless roll of web material relative to the respective brace 14, 14A, 14B. As disclosed above, each arm 46 and respective sides 52, 54 of each brace 14, 14A, 14B have an at rest orientation, configuration or shape wherein protrusions 60, 64 can loosely engage and self-support a respective coreless roll of web material when the respective roll is disposed between sides 52, 54. At rest, sides 52, 54 are preferably oriented such that protrusions 60, 64 are oriented slightly axially inboard or provide a compressive force associated with a dimension associated with the respective end faces of a respective roll of coreless web material. Tab 74 can be gripped by the user when dispenser 12 is open such that side 56 can be displaced in an outward axial direction or a direction generally aligned with the intended axis of rotation of the associated coreless roll of web material relative to side 54 such that a coreless roll of web material can be more conveniently positioned between the terminal free ends of protrusions 60, 64. Releasing tab 74, and thereby the deflection of side 56 relative to side 52, allows protrusions 60, 64 to engage the coreless center portion of a discrete roll positioned therebetween. Preferably, when tab 74 released, the respective brace 14, 14A, 14B returns toward the at rest orientation and provides a contact engagement between protrusions 60, 64 and the coreless roll of web material that is sufficient such that protrusions 60, 64 engage and support the respective roll. It is appreciated that in some configuration, manual manipulation of side 56 toward side 52 of the respective brace 14, 14A, 14B may provide overlapping or more robust frictional interaction between protrusions 60, 64 and the underlying roll of web material to provide a more secure supported interaction therebetween prior to the closing of cover 22 of dispenser 12.

In one embodiment of the present invention, shown in FIG. 5, the roll brace 14 may be disposed in cavity 16 of the housing 18 and secured relative thereto by way of connecting the outer surface 70 of the first arm 52 of the respective roll brace 14 to the inner surface 72 of the back wall 24 of the base 20. One or more tabs 68, extending rearwardly from the outer surface 70 of the first arm 52 may engage receiving slots (not shown) in the back wall 24 of the base 20. Engagement of the tabs 68 into the receiving slots may allow the roll brace 14 to be removably affixed to the housing 18 for ease of use and replacement. As to increase the stability of roll brace 14 when affixed to the housing 18, a lower portion of the first arm 52 may include an increased surface area, such as in the form of a disk 80, shown in FIG. 3.

Returning to FIG. 5, in one embodiment of the present invention in which the roll brace 14 is affixed to the housing 18, the first angle 54 will have a value that is preferably no less than that of the second angle 58 when the dispenser 12 is in an open position. More preferably, when the cover 22, which may be hingedly affixed to the base 20 about hinge 82, is opened, the roll brace 14 is allowed to relax to an at rest position, as shown in FIG. 5. When the cover 22 of the housing 18 is opened, no compression force is exerted on the roll brace 14, thereby allowing it to expand into the relaxed position. In this relaxed or rest position, the second side 56 of the roll brace 14 will pivot outwardly away from the back wall 24 of the housing, such that the first angle 54 will have a value that is less than that of the second angle 58. Similarly, in this relaxed position the longitudinal axis of the first protrusion 60 will not be coaxial with the longitudinal axis of the second protrusion 64, which is to say that the longitudinal axis of the first protrusion 60 will be at an angle relative to the longitudinal axis of the second protrusion 64.

In the embodiment of the present invention in which the roll brace 14 is in the relaxed position, as shown in FIG. 5, the dispenser system 10 is well suited for inserting and receiving a roll of coreless web material within the roll brace 14. That is to say, that in the relaxed position, the distance between the first protrusion 60 and the second protrusion 64 will be of a sufficient length as to accommodate receiving a roll of coreless web material between the first protrusion 60 and the second protrusion 64, and preferably approximately equal to or greater than a width or axial length of the roll of coreless web material. Similarly, in one embodiment of the present invention, the distance from the first protrusion 60 and the second protrusion 64 to the arm 46 is preferably approximately equal to or greater than the radius of the roll of coreless web material, as to facilitate receiving the roll in the roll brace 14. In one embodiment of the present invention, the roll brace 14 may be formed of a semi-elastic of flexible material such as plastic or other suitable material, as to accommodate flexing of the roll brace 14 as a roll of coreless web material is received therein.

Figure 6:
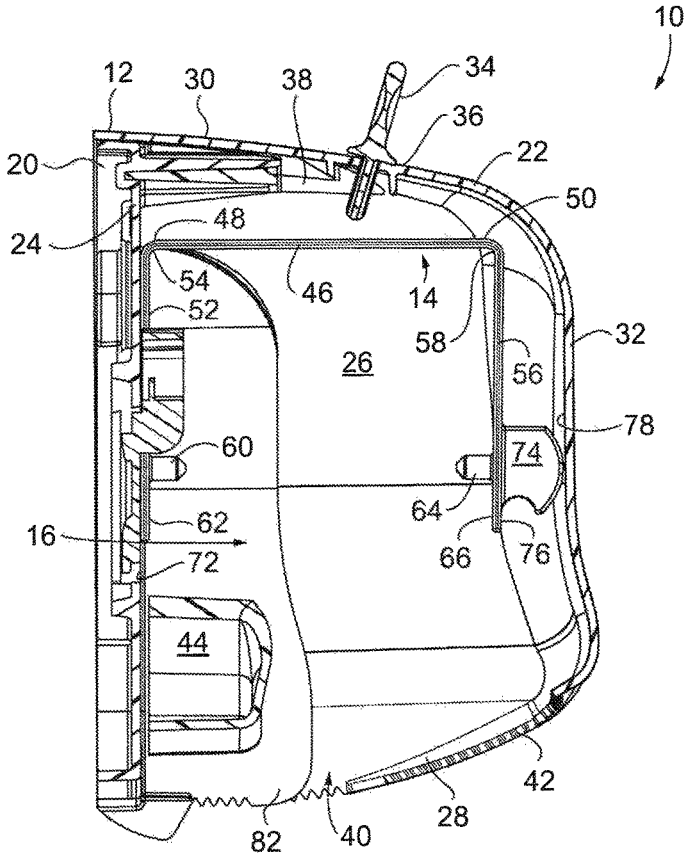
FIG. 6 is a view similar to FIG. 5 with the dispensing apparatus shown in FIG. 1 in a closed orientation.

Turning now to FIG. 6, in one embodiment of the present invention in which the roll brace 14 is affixed to the housing 18, the first angle 54 is shown as approximately equal the second angle 58 when the dispenser 12 is in a closed position. That is to say that when the cover 22 is closed, the roll brace 14 is flexed or deflected into a contracted or compressed position, as shown in FIG. 6. When the cover 22 of the housing 18 is closed, the inner surface 78 of the front 28 of the cover 22 contacts and engages the tab 74 extending from the outer surface 76 of the second side 56 of the brace 14 thereby exerting a compression force on the roll brace 14. It is appreciated that the interior surface of cover 22 could include a protrusion or projection similar to tab 74 configured to engage side 56 when cover 22 is closed to provide the compression force as disclosed further below.

Regarding of the orientation of the tab as being associated with either of side 56 of brace 14, 14A, 14B or the interior surface of cover 22, as a result of this compression force, the roll brace 14 transitions from the relaxed or at rest position shown in FIG. 5 to the contracted or compressed position as shown in FIG. 6 when cover 22 is closed. In this contracted or compressed position, the second side 56 of the roll brace 14 pivots inwardly towards the back wall 24 of the housing, such that the first angle 54 will be approximately equal to the second angle 58. In one embodiment of the present invention, the first angle 54 and second angle 58 of the roll brace 14 are approximately ninety degrees, when the dispenser 12 is in a closed position. Similarly, when the roll brace 14 is in this contracted position the longitudinal axis of the first protrusion 60 will be approximately coaxial the longitudinal axis of the second protrusion 64, which is to say that the longitudinal axis of the first protrusion 60 will be generally parallel to the longitudinal axis of the second protrusion 64. As such, the first and second protrusions 60, 64 may define a linear imaginary axis upon which the coreless roll of web material may rotate during incremental dispensing of the web material.

In the embodiment of the present invention in which the roll brace 14 is in the contracted position, as shown in FIG. 6, the dispenser system 10 is well suited for retaining a roll of coreless web material within the roll brace 14. That is to say, that in the contracted or compressed position, the distance between the first protrusion 60 and the second protrusion 64 will be preferably approximately less than a width or longitudinal axial length of the roll of coreless web material. As such, the distance between the first protrusion 60 and the second protrusion 64 will be of a sufficient length as to pass partially within the interior of the coreless roll of web material generally at a location at or near the center of the coreless roll of web material. In this configuration, the reduced distance between the first protrusion 60 and the second protrusion 64, when the roll brace 14 is in the contracted position will exert a holding force on the coreless roll of web material as to substantially inhibit lateral movement of the roll when the dispenser 12 is in a closed position. Similarly, in one embodiment of the present invention, the reduced distance between the first protrusion 60 and the second protrusion 64, when the roll brace 14 is in the contracted position will prohibit lateral disengagement of the coreless roll of web material from the roll brace 14 roll when the dispenser 12 is in a closed position.

In use, and in accordance with one embodiment of the present invention, the dispenser 12 is placed in an open position by means of pivoting the cover 22 away from the base 20, about hinges 82. In the open orientation, the first and second roll braces 14A, 14B will expand into their relaxed positions, which is to say that the distance from the first protrusion 60 to the second protrusion 64 expands to a distance approximately equal to or slightly greater than a width of the coreless roll of web material, as described above. A first coreless roll of web material is then inserted into the first roll brace 14A, such that the first and second protrusions 60, 64 are aligned with the relative center of the roll. Similarly, a second coreless roll of web material is then inserted into the second roll brace 14B, such that the first and second protrusions 60, 64 are aligned with the relative center of the roll. The roll shield 44 is then maneuvered into its starting position, adjacent the first roll brace 14A, as shown in FIG. 1. Once the roll braces 14A, 14B, have received their respective rolls, the cover 22 is pivoted about hinges 82 into a closed position, and secured in this closed position. As a result of closing the dispenser 12, the inner surface 78 of the front 28 of the cover 22 contacts and engages the tab 74, on both the first and second roll braces 14A, 14B, which, in turn exerts a compression force on the roll braces 14A, 14B. As a result of this compression force, the roll braces 14A, 14B transition from the relaxed position to the contracted or compressed position. In the contracted position, the first and second protrusions 60, 64 become coaxially aligned and are preferably driven into the interior of the respective coreless rolls of web material, wherein they define a rotational axis about which the respective rolls rotate during dispense events. The user may then access and grasp an exposed end of the web material that extends downwardly through the aperture 40 or manually rotate the roll to acquire the end via rotation of the roll about the first and second protrusions 60, 64. Once the desired length of web material have been extended through the aperture 40, it may be disengaged from the roll by tearing the web material along the edge of housing 18 and/or interference with an optional knife or cutting element such as serrated edge 42. Understandably, when provided, the cutting implement or element such as serrated edge 42 can be freely contacted by the user without injury but interacts with the web material in a manner to effectuate separation of the same.

The dispenser of the present invention may have other applications aside from use with rolls of web material, such as but not limited to tissue paper, hand towel, and toilet paper. Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims. The present invention has been described in terms of the preferred embodiment, and it is recognized that equivalents, alternatives and modifications, aside from those expressly stated, are possible and within the scope of the appending claims.

We claim:

1. A coreless web material dispensing apparatus, the apparatus comprising:

a housing having a base, a cover that is connected to the base to rotate relative to the base about an axis of rotation, and a cavity defined between the base and the cover;

at least one brace extending from the base to the cover, and configured to retain a roll of web material therein;

wherein, when the housing is in a closed orientation, the at least one brace receives a compression force from the cover and compresses the at least one brace into engagement with the roll of web material defining an axis of rotation of the roll of coreless web material that is generally transverse to the axis of rotation of the cover; and wherein, the compression force prohibits lateral disengagement of the at least one brace from the roll of web material.

2. The dispensing apparatus of claim 1 wherein the at least one brace comprises:

an arm having a first end, a second end and a length extending between the first end and the second end;

a first side extending at an angle from the first end of the arm; and a second side extending at an angle from the second end of the arm.

3. The dispensing apparatus of claim 2 wherein the at least one brace further comprises:

a first protrusion extending from an inner surface of the first side towards the opposing second side;

a second protrusion extending from an inner surface of the second side towards the opposing first side; and a tab extending from an outer surface of the second side towards the cover.

4. The dispensing apparatus of claim 3 wherein when the housing is in the closed orientation, the tab is configured to engage an inner surface of the cover and translate the compression force to the second side of the at least one brace.

5. The dispensing apparatus of claim 3 wherein when the housing is in the closed orientation, a distance from the inner surface of the first side to the inner surface of the second side is less than when the housing is in an opened orientation such that the at least one brace does not receive the compression force from the cover.

6. The dispensing apparatus of claim 5 wherein when the housing is in the closed orientation, the distance from the inner surface of the first side to the inner surface of the second side is approximately equal to a length of the roll.

7. The dispensing apparatus of claim 3 wherein the at least one brace further comprises a first brace configured to receive a first roll and a second brace configured to receive a second roll.

8. The dispensing apparatus of claim 1 further comprising a roll shield that is movable relative to the housing to be disposed proximate one of the at least one brace or another brace and configured to prevent access to a roll of web material disposed proximate the roll shield.

9. The dispensing apparition of claim 1 wherein the housing defines an aperture between the base and the cover when the housing is in the closed orientation.

10. The dispensing apparatus of claim 9 wherein an edge of the aperture includes a serrated edge configured to selectively sever the web material when the web material is introduced to the serrated edge.

11. A dispensing apparatus comprising:

a housing having a base, a cover connected to the base and rotatable relative thereto about an axis of rotation of the cover, a cavity defined between the base and the cover, and an aperture between the base and the cover;

an at least one brace extending from the base to the cover, and configured to retain a roll of web material therein, the brace comprising:

an arm having a first end, a second end and a length extending between the first end and the second end;

a first side extending at an angle from the first end of the arm;

a second side extending at an angle from the second end of the arm;

a first protrusion extending from an inner surface of the first side toward the second side;

a second protrusion extending from an inner surface of the second side toward the first side; and a tab extending from an outer surface of the second side toward the cover; and wherein when the housing is in a closed orientation, the tab is configured to engage an inner surface of the cover and translate a compression force to the second arm of the at least one brace to compress the at least one brace toward the roll retained therein and defining an axis of rotation for the roll that is generally transverse to the axis of rotation of the cover; and wherein the compression force prevents lateral translation of the first protrusion away from the second protrusion.

12. The dispensing apparatus of claim 11 wherein the at least one brace comprises a first brace configured to receive a first roll and a second brace configured to receive a second roll.

13. The dispensing apparatus of claim 11 further comprising a roll shield movably disposed adjacent the at least one brace.

14. The dispensing apparatus of claim 11 wherein the cover is hingedly affixed to the base.

15. The dispensing apparatus of claim 11 further comprising a serrated edge associated with the aperture and oriented to selectively cut the web material.

16. The dispensing apparatus of claim 11 wherein when the housing is in the closed orientation, a longitudinal axis of the first protrusion is coaxial with a longitudinal axis of the second protrusion and defines the axis of rotation for the roll.

17. The dispensing apparatus of claim 16 wherein when the housing is in an opened orientation the tab is offset from the inner surface of the cover such that the longitudinal axis of the first protrusion is oriented at an angle relative to the longitudinal axis of the second protrusion.

18. The dispensing apparatus of claim 16 wherein the first protrusion is rotationally connected to the first side of the brace and the second protrusion is rotationally connected to the second side of the brace.

19. A brace configured to support a roll of coreless web material relative to a housing such that the web material can be incrementally dispensed from the housing by unrolling of the roll of coreless web material, the brace comprising:

a first portion that extends in a length direction aligned with a length of the roll of coreless web material;

a second portion that extends from the first portion in a crossing direction relative to the length direction associated with the first portion such that the second portion extends in a direction that is generally transverse to an axis of rotation of the roll of coreless web material;

a projection that extends from the second portion in a direction generally aligned with the axis of rotation of the roll of coreless web material; and wherein the second portion is constructed to cooperate with a cover of the housing such that closing of the cover via movement of the cover in a direction that is generally transverse to the axis of rotation of the roll biases the projection into compressive engagement with the roll of coreless web material.

20. The brace of claim 19 further comprising a third portion that extends from the first portion at a location offset from and in a direction generally aligned with the second portion.

21. The brace of claim 19 wherein the first portion and the second portion are integrally formed as a one-piece body.

22. The brace of claim 19 wherein the projection is at least one of formed integrally with the second portion and removably supported by the second portion.

23. The brace of claim 19 wherein the brace is configured to be received between a base and the cover of the housing and the housing defines an aperture and a serrated knife is associated with the aperture and oriented to selectively cut the coreless web material.

* * * * *